United States Patent [19]

Roccaforte

[11] 4,262,814

[45] Apr. 21, 1981

[54] DEVICE FOR DETECTING TAMPERING WITH A CAPPED CONTAINER AND BLANK THEREFOR

[75] Inventor: Harry I. Roccaforte, Western Springs, Ill.

[73] Assignee: Champion International Corporation, Stamford, Conn.

[21] Appl. No.: 49,154

[22] Filed: Jun. 18, 1979

[51] Int. Cl.[3] ..... B65D 85/54; B65D 5/02; B65D 65/06

[52] U.S. Cl. ..... 215/232; 206/247; 206/434; 206/460; 215/274; 215/252; 229/40

[58] Field of Search ..... 229/40, 87 C; 206/434, 206/145, 179, 194, 197, 199, 459, 460, 247; 215/252, 232, 273, 274

[56] References Cited

U.S. PATENT DOCUMENTS

| | | | |
|---|---|---|---|
| 1,908,245 | 5/1933 | Hogg | 215/252 |
| 2,722,365 | 11/1955 | Phipps | 229/40 |
| 2,878,931 | 3/1959 | Stroheim | 215/273 X |
| 3,253,729 | 5/1966 | Virany | 215/277 X |
| 3,386,643 | 6/1968 | Gentry | 229/40 |
| 3,552,082 | 1/1971 | Howard | 229/40 X |
| 3,773,170 | 11/1973 | Rossi | 229/40 X |

FOREIGN PATENT DOCUMENTS

| | | | |
|---|---|---|---|
| 963856 | 3/1975 | Canada | 206/434 |
| 2308559 | 11/1976 | France | 206/434 |
| 1436166 | 5/1976 | United Kingdom | 206/434 |

*Primary Examiner*—Davis T. Moorhead
*Attorney, Agent, or Firm*—Evelyn M. Sommer

[57] ABSTRACT

A wrapping device, formed of a unitary paperboard blank, secured tightly against the sides of a container and against the cap thereon, which is easily torn upon attempted upward movement of the cap for the purpose of, for example, the attempted fraudulent switching of a low price-marked cap to a larger size, higher priced container. The wrapping device is in the form of an elongated strap of paperboard, which has at least one aperture therein through which a part of the container's cap protrudes. A carton for a plurality of capped containers is formed from a plurality of the wrapping devices, which are in turn formed from a unitary blank. An assembly for a plurality of capped containers is formed from a plurality of the wrapping devices releasably coupled together.

42 Claims, 21 Drawing Figures

DEVICE FOR DETECTING TAMPERING WITH A CAPPED CONTAINER AND BLANK THEREFOR

The present invention relates to a wrapping device for capped containers, formed of a unitary blank of paperboard. Each device is secured tightly against the sides of a container and against the cap on the container and is easily torn upon attempted upward movement of the cap. The purpose of the wrapping device is to detect the attempted fradulent switching of a low price-marked cap from one container to another container of larger size and higher price. The wrapping device is in the form of a elongated strap or piece of paperboard which has at least one aperture therein through which a part of the container's cap protrudes. The invention also relates to a carton and an assembly for a plurality of capped containers which are formed from a plurality of the wrapping devices. The invention also relates to the configuration of the unitary blanks forming various embodiments of the wrapping device.

Numerous consumer products are presently marketed in containers, or bottles, which have screw-off or pull-off caps, in which a large number of differently sized bottles can utilize the same sized cap. An example of such a product is a roll-on deodorant. As is often done, once the consumer product in the form of a capped container is delivered to the retail outlet, a price is marked on the cap, the price depending upon the size of the container carrying the consumer product. After price-marking has been accomplished, it is usually the practice to display the product in a specific area which includes the various sizes of the product container.

Thus, since the products are usually displayed on shelves some distance from a cashier or other store employee, there is an opportunity for a dishonest consumer to attempt to fraudulently remove a price-marked cap from a small sized container and replace the higher price-marked cap therewith on the larger sized container. This, of course, would result in the dishonest consumer paying the lower price and obtaining the larger sized container of the product.

One method in the prior art is known which would detect tampering with price-marked caps and this is utilized on liquor bottles. Specifically, a strip of material is adhered to the liquor bottle cap as well as to the neck of the liquor bottle. Thus, if the cap is removed the strip of material is torn or otherwise disconnected from the cap or bottle. However, this type of device has numerous disadvantages when applied to somewhat cheaper consumer products. Specifically, the strip adhered to the cap and the bottle is usually not easily removable and, therefore, results in an unsighly product to be utilized by the consumer. In addition, these prior art strips are usually rather small and are unable to carry significant advertising copy thereon which would somewhat justify the added expense in materials and labor. Moreover, these types of prior art strips are usually formed of heavy plastic materials which are expensive in terms of material costs.

Accordingly, it is a main object of the present invention to overcome the limitations and drawbacks associated with the known prior art and to provide a new and improved wrapping device for a capped container to detect tampering with a price-marked cap.

Another object of the present invention is to provide such a wrapping device which is formed of a unitary blank of paperboard which is relatively inexpensive in terms of material costs.

Another object of the present invention is to provide such a wrapping device which can be automatically applied to a consumer product using high speed automated machines.

Another object of the present invention is to provide such a wrapping device which detects tampering with a price-marked cap which is easily removable by the consumer after purchase.

Another object of the present invention is to provide such a wrapping device which can carry advertising thereon.

Another object of the present invention is to provide a carton formed of a plurality of the wrapping devices so that a plurality of capped containers can be simultaneously enclosed for shipment.

Another object of the present invention is to provide a plurality of wrapping devices for a plurality of capped containers in which the wrapping devices can easily be coupled to form an assembly thereof.

The foregoing objects are basically attained by providing a device for detecting tampering with a cap on a container, the combination comprising a harness received on the cap; two legs, each forming an extension on opposite sides of the harness; the harness and legs being formed of tearible material; and means for securing the legs tightly against opposed sides of the container and for securing the harness tightly against the cap so that upward movement of the cap tears the device, the harness having means defining at least one aperture therein permitting protrusion of a part of the cap through the harness.

As seen in FIGS. 1–4, a wrapping device and unitary blank therefor in accordance with the present invention is shown which comprises an elongated piece of material having two opposed apertures through which parts of the cap protrude and a central aperture through which the price can be marked on the cap therebeneath. The device is tightly secured against the cap and the container sides by overlapping bottom portions of the elongated piece, which are coupled together on the bottom of the container.

As seen in FIGS. 5–8, a modified embodiment of the wrapping device and unitary blank in accordance with the present invention is shown in which there is one aperture through which a part of the cap protrudes and in which the two legs are directly adhered to sides of the container.

As seen in FIGS. 9–12, another modified wrapping device and unitary blank in accordance with the present invention is shown similar to that seen in FIGS. 4–8; however, various fold lines are located differently.

As seen in FIGS. 13–17, a unitary blank and a carton is formed from a plurality of the wrapping devices in accordance with the present invention, which are severable from one another.

And as seen in FIGS. 18–21, an assembly of a plurality of wrapping devices in accordance with the present invention can be releasably coupled to enclose a plurality of capped containers.

In all of these embodiments, once the wrapping device is secured to the capped container, an upward movement of the cap results in tearing of the wrapping device, thereby indicating to the cashier that a potential tampering with the price-marked cap has occured. Appropriate action can then be taken on behalf of the retail store.

Other objects, advantages and salient features of the present invention will become apparent from the following detailed description, which, taken in conjunction with the annexed drawings, discloses preferred embodiments of the present invention.

Referring to the drawings which form a part of this original disclosure:

Figure 19:
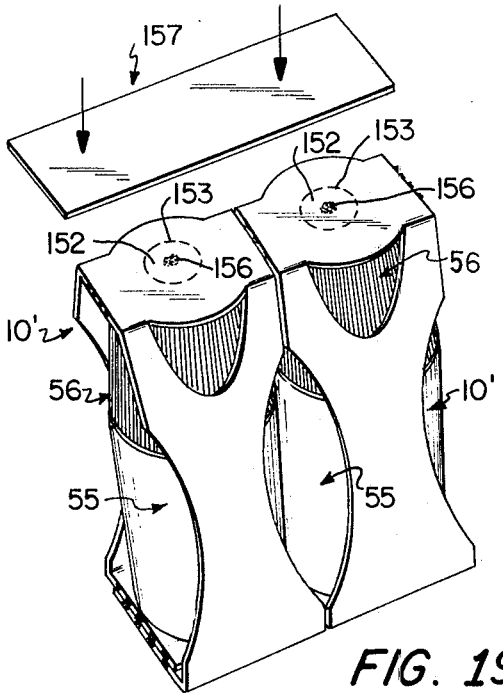
FIG. 19 is a right perspective view of two wrapping devices formed from the blank shown in FIG. 18 which have been secured to two capped containers and severed from one another with a coupling strip about to be adhered thereto by means of adhesive located in the circular areas defined by the perforated lines.
Figure 20:
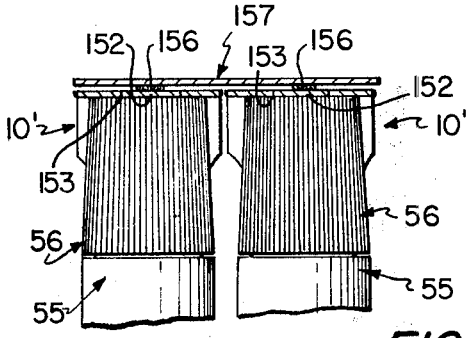
Figure 21:
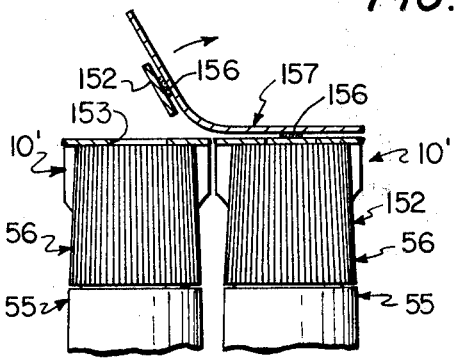

FIG. 20 is a fragmentary elevational view in longitudinal section of the coupled wrapping devices and capped containers shown in FIG. 19; and FIG. 21 is a fragmentary elevational view in longitudinal section of the wrapping devices and capped containers shown in FIG. 20, except that the coupling strip has been pulled away from one of the wrapping device carrying with it the area defined by the perforated circular line.

Figure 1:
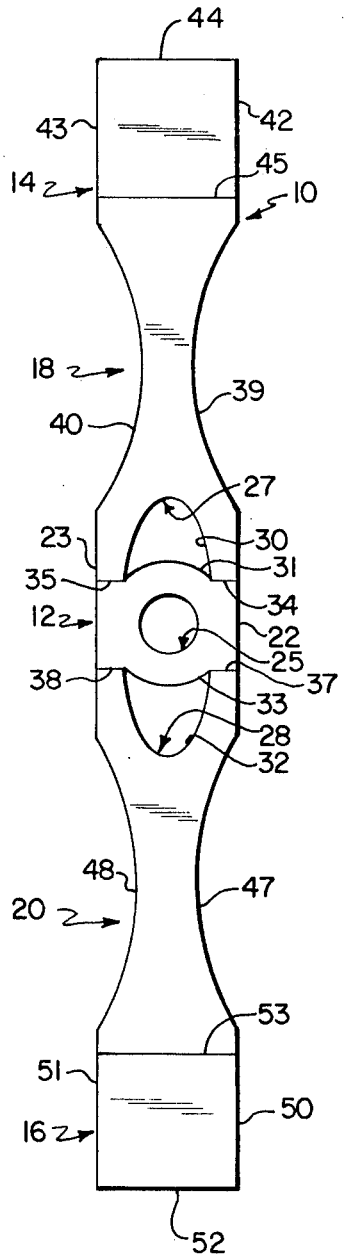
FIG. 1 is a top plan view of the outside surface of a blank forming a wrapping device in accordance with the present invention with interior straight lines indicating fold lines.

Referring now to the drawings in further detail, the unitary blank 10 shown in FIG. 1 is preferably formed of thin, foldable and tearible paperboard. The blank 10 is basically in the form of an elongated rectangle with four curvilinear portions formed two sets of opposed indentations along the length thereof. The blank is symmetrical about its central longitudinal axis and about its central transverse axis. Specifically, the blank 10 comprises a central area 12, a first end area 14, a second end area 16, a first intermediate area 18 between the central area and the first end area 14, and a second intermediate area 20 between the central area and the second end area 16.

The central area 12 is basically in the form of an elongated rectangle having opposed, parallel straight side edges 22 and 23 which advantageously have a distance therebetween greater than the longest dimension of the top of the cap to be associated therewith. Located in the central area 12 is a central, circular aperture 25,which is evenly spaced between side edges 22 and 23 and which has a diameter substantially equal to one-third the distance between the side edges. Two opposed side apertures 27 and 28 are located in the central area 12 and extend partly into intermediate areas 18 and 20. These side apertures 27 and 28 are respectively formed from the intersection of a parabola 30 and an arc of a circle 31 and a parabola 32 and an arc of a circle 33. Each of the parabolic portions of the apertures has its apex extending into the adjacent intermediate area and each such parabolic and arc portion is bisected by the central longitudinal axis of blank 10 extending between the first and second end areas 14 and 16. Each of the arcs 31 and 33 are approximately 90° in circumferential extent and have a radius of curvature substantially equal to twice the radius of the central aperture 25. Advantageously, this radius of curvature equals the radius of the top of the cap to which the blank 10 is to be secured. The center point of the central aperture is the same as the center point for the radius of curvature of both arcs 31 and 33, which arcs form convex edges of the aperture.

A first pair of fold lines 34 and 35, formed in blank 10 by means of a light scoring thereof, extend respectively from side aperture 27, at the intersections of the arc 31 and parabola 30, to the side edges 22 and 23 of the central area. These fold lines 34 and 35 are substantially perpendicular to the side edges and are in the same straight line.

Similarly, a second pair of fold lines 37 and 38 extend from aperture 28, respectively, to the opposed side edges 22 and 23 of the central area 12. These fold lines are in the same straight line, are substantially perpendicular to edges 22 and 23, and extend from the intersections of arc 33 and parabola 32.

As seen in FIG. 1, the first intermediate area 18 is formed from opposed concave side edges 39 and 40 which extend from the side edges 22 and 23 of central area 12 to the first end area 14.

This first end area 14 is substantially rectangular and has an exterior edge formed by two opposed, parallel straight side edge portions 42 and 43 and an end edge portion 44 which is straight and perpendicular to edge portions 42 and 43. The side edge portions 42 and 43 have a distance therebetween substantially the same as the distance between side edges 22 and 23 of the central area 12 and have a straight fold line 45 extending therebetween which is parallel to end edge portion 44 and is slightly spaced from the intersection of the side edge portions 42 and 43 with the concave side edges 39 and 40 of the intermediate area 18.

As seen in FIG. 1, the second intermediate area 20 is substantially a mirror image of intermediate area 18 and has similar concave side edges 47 and 48. In addition, the second end area 16 is substantially the mirror image of the first end area 14 and includes two side edge portions 50 and 51, end edge portion 52 and a fold line 53, all of which are in the mirror image configuration as those related parts described above regarding the first end area 14.

Advantageously, the length of the blank 10 between fold lines 34–35 and 45 and between fold lines 37–38 and 53 is the same and is substantially the same as the total height of the capped container to be wrapped therein. The length of each end area is substantially equal to the width of the bottom of the capped container to be associated therewith. In this regard, the entire blank 10 advantageously has an overall length which is greater than the outer periphery of the capped container to be associated therewith. The distance between fold lines 34–35 on one hand and fold lines 37–38 on the other is less than the largest width of the cap to be associated therewith.

Figure 2:
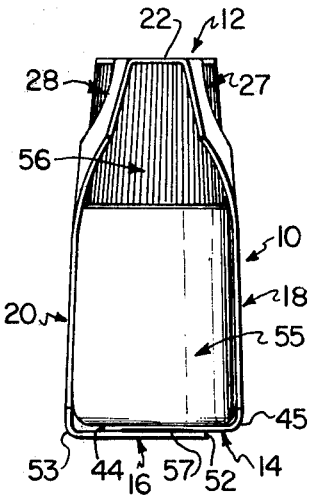
FIG. 2 is a right side elevational view of the wrapping device shown in FIG. 1 coupled to a container having a cap thereon.
Figure 3:
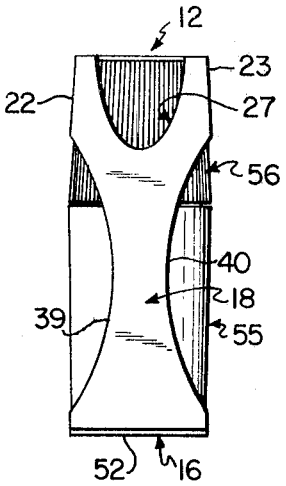
FIG. 3 is a front elevational view of the wrapping device and capped container shown in FIG. 2.
Figure 4:
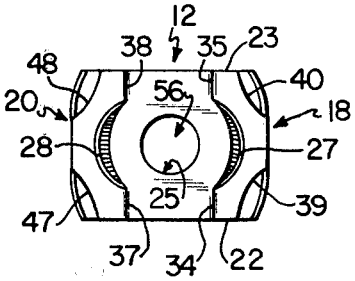
FIG. 4 is a top plan view of the wrapping device coupled to the capped container shown in FIG. 2.

Referring now to FIGS. 2–4, the blank 10 is shown forming the wrapping device in accordance with the present invention. Specifically, the product to be so wrapped is formed from a container 55, such as a bottle, having a cap 56 on the top thereof closing the container. This cap 56 is releasably coupled to the container by means of threads or by means of a force fit. In all events, the cap 56 is removable from the container 55 upon upward movement of the cap relative to the container. As shown in FIGS. 2–4, the cap has a substantially frusto-conical shape with a base larger than the top thereof; however, this cap utilized in association with the blank 10 of FIG. 1 could also have an inverted frusto-conical, substantially spherical, cylindrical or polygonal shape.

In order to wrap the combined container and cap, the blank 10 is maneuvered so that the area thereof defined between the side edges 22 and 23, fold lines 34, 35, 37 and 38 and arcs 31 and 33 is placed on the flat top surface of cap 56. Then, the blank 10 is folded along fold lines 34–35 and 37–38 so that the remaining part of the central area 12 and the intermediate areas 18 and 20 contact opposed sides of cap 56 and container 55. Finally, the blank is pulled tightly downwards against the cap and the sides of the container with the end areas 14 and 16 being folded along their respective fold lines 45 and 53 into an overlapping relationship at the bottom of the container 55. In this position, the end areas are substantially parallel to each other and perpendicular to the remaining part of the blank and the overlapping end areas are then attached together by adhesive 57 interposed therebetween.

As seen in FIGS. 2–4, the wrapping device formed from blank 10 has two opposed parts of cap 56 protruding through the apertures 27 and 28. In this regard, it is advantageous that the overall length in the vertical direction of cap 56 is greater than the distance between each arc 31 and 33 and the furthermost point on parabolic portions 30 and 32 in the apertures 27 and 28 to prevent the cap from being slid out through the apertures. Similarly, the largest width of each aperture 27 and 28 is less than the width of the cap.

As seen, the blank 10 in the wrapping position forms a harness from a combination of the central area 12 and a portion of intermediate areas 18 and 20 which is received on the cap. In addition, portions of the intermediate areas 18 and 20 against the sides of the container form two legs which are extensions on opposite sides of the harness. Since the blank is secured at the bottom by means of the adhesive 57 between end areas 14 and 16, the two legs are secured tightly against the opposed sides of the container 55 and the harness is secured tightly against the cap so that upward movement of the cap, in an attempt to fraudulently remove the cap, tears the overall blank 10. Thus, once the product formed from the container 55 and cap 56 has the cap price marked and is wrapped with blank 10, any attempt to change the price-marked cap would result in tearing of the wrapping device and provide notice to the cashier upon checkout of the product. Since the areas of fold lines 34, 35, 37 and 38 are lightly scored, it is in these areas where tearing would more likely initially occur.

As specifically seen in FIG. 4, the circular aperture 25 can advantageously define an area on the top of cap 56 where the price marking can be accomplished, so that the price is clearly visible through the wrapping device. In addition, the wrapping device can have various advertising copy of materials thereon to help inform the consumer regarding the product. Moreover, once the consumer has the capped container with the wrapping device thereon at home and ready for use, the wrapping device can be readily removed therefrom by tearing thereof.

As seen in FIGS. 2 and 3, once the wrapping device is secured about the combined cap and container, it is quite difficult to remove the capped container therefrom in a sidewise direction since the cap 56 has two parts protruding through the apertures 27 and 28.

Referring now to FIGS. 5–8, a modified embodiment of the wrapping device in accordance with the present invention is shown in which a smaller blank 60 is provided, which has portions extending only part way down the sides of the container, where they are directly adhered thereto.

Blank 60 is comprised of a central area 61, a first end area 62, a second end area 63, a first intermediate area 64 and a second intermediate area 65. This blank 60 is also advantageously formed of a unitary blank of paperboard or cardboard which is thin, foldable and tearable. The blank is symmetrical about its central longitudinal axis and about its central transverse axis.

Figure 5:
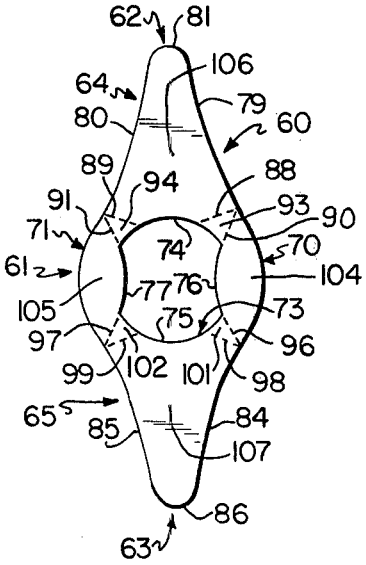
FIG. 5 is a top plan view of a modified blank forming a wrapping device in accordance with the present invention in which the interior straight dashed lines indicate perforated fold lines.

The central area 61 has two opposed outwardly convex side edges 70 and 71 in the form of arcs of a circle and has an interior aperture 73 located between these side edges. The aperture 73 has four interior edges comprising two opposed concave edges 74 and 75 and two opposed convex edges 76 and 77. These edges all intersect to form aperture 73. The concave edges extend across and are bisected by the central longitudinal axis of the blank between the end areas and the convex edges extend across and are bisected by the central transverse axis of the blank between the central area side edges. The concave edges 74 and 75 are each an arc of a circle with a circumferential extent of about 110°–115°. Similarly, the convex edges 76 and 77 are each an arc of a circle having a circumferential extent of about 65°–70°. The blank 60 shown in FIG. 5 is intended to be used with a cap having a base larger than the top thereof, such as a frustum, so that the radius of curvature of each of the concave edges 74 and 75 is less than the largest radius of the cap to be associated therewith. That is, an upward movement of the cap, once it is received in aperture 73, brings the bottom of the cap into contact with the material defining the aperture, thereby tearing this material. In this regard, the radius of curvature of the convex edges 76 and 77 can advantageously have the same radius of curvature as edges 74 and 75.

The first intermediate area 64 has two opposed concave side edges 79 and 80 in the form of converging arcs of circles, these side edges extending respectively from the side edges 70 and 71 of central area 61. These side edges 79 and 80 extend into the U-shaped end edge 81 of the first end area 62.

Similarly, the second intermediate area 65 has opposed concave side edges 84 and 85 extending respectively from the other ends of side edges 70 and 71 of the central area 61 and converge into the U-shaped end edges 86 of the second end area 63.

The overall length of blank 60 between the end edges 81 and 86 is less than the overall outer periphery of the combined cap and container to be used therewith; however, this overall length is such that the cap can be received in aperture 73 and the end areas 62 and 63 are in contact with the opposed sides of the container.

As seen in FIG. 5, there are eight fold lines formed in blank 60 by means of eight substantially straight perforated score lines. A first pair of fold lines 88 and 90 extend from concave edge 74 respectively to the opposed side edges 70 and 71 of the central area. A second pair of fold lines 90 and 91 extend respectively from the opposed intersections of edge 74 and edges 76 and 77 to side edges 70 and 71 of the central area 61. Fold lines 88 and 90 substantially intersect each other at side edge 70 and define therebetween in conjunction with a portion of edge 74 at substantially triangular area 93. Similarly, fold lines 89 and 91 substantially intersect each other at side edge 71 and define therebetween in conjunction with a part of edge 74 a second substantially triangular area 94.

Similarly, a third pair of fold lines 96 and 97 extend respectively from the intersections of edge 75 and edges 76 and 77 into the opposed side edges 70 and 71 of central area 61. A fourth pair of fold lines 98 and 99 extend from the edge 75 respectively into contact with oposed side edges 70 and 71, wherein fold line 78 substantially intersects with fold line 96 at edge 70 and fold line 99 substantially intersects with fold line 97 at edge 71.

Fold lines 96 and 98 define therebetween in conjunction with a part of edge 75 a third substantially triangular area 101 and fold lines 97 and 99 define therebetween in conjunction with another portion of edge 75 a fourth substantially triangular area 102.

As seen in FIG. 5, these various fold lines define or separate the blank 60 into four large portions comprising a first portion 104, a second portion 105, a third portion 106 and a fourth portion 107.

As seen in FIG. 5, the first portion 104 is defined between fold lines 90 and 96 and edges 70 and 76. The second portion 105 is defined between fold lines 91 and 97 and edges 71 and 77. The third portion 106 is defined between fold lines 88 and 89, a portion of edge 74, edges 79, 80 and 81 and, the fourth portion 107 is defined by fold lines 98 and 99, a portion of edge 75 and edges 84, 85 and 86.

Figure 6:
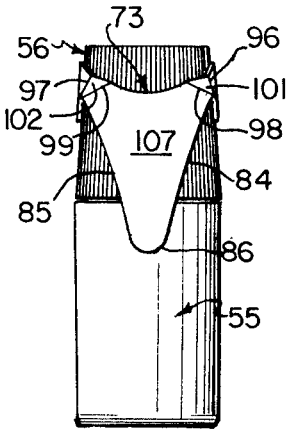
FIG. 6 is a front elevational view of the wrapping device shown in FIG. 5 coupled to a capped container.
Figure 7:
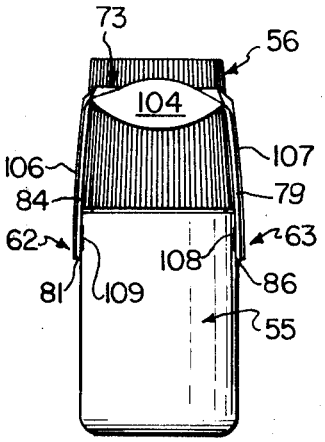
FIG. 7 is a right side elevational view of the wrapping device and capped container shown in FIG. 6.
Figure 8:
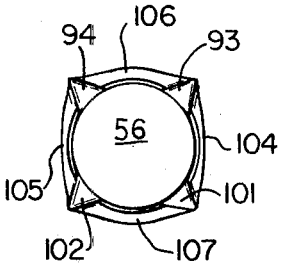
FIG. 8 is a top plan view of the wrapping device and capped container shown in FIG. 6.

Referring now to FIGS. 6–8, the blank 60 is shown in a configuration in which it is associated with container 55 having cap 56 thereon, which is substantially the same container and cap shown in FIGS. 2–4. The cap has a frusto-conical shape.

In order to maneuver the blank 60 over the capped container shown in FIGS. 6–8, the first portion 104 and the opposed second container 105 are pivoted about fold lines 90 and 96 and fold lines 91 and 97, respectively, and the blank 60 is simultaneously moved down over cap 56, with cap 56 received in aperture 73 in blank 60. In addition, opposed third portion 106 and fourth portion 107 are folded respectively about fold lines 88 and 89 and fold lines 98 and 99 so that they are in contact with the opposed sides of cap 56 and container 55, as seen in FIGS. 6 and 7. As also seen therein, the first and second portions 104 and 105 are also in contact with the other opposed sides of cap 56.

As seen in FIGS. 6 and 7, the end edges 81 and 86 of blank 60 extend below the cap 56 onto the opposed sides of container 55. It is here that the end areas 62 and 63 are adhered to the opposed sides of the container 55 by means of strips of adhesive 108 and 109 interposed therebetween.

This adhering is accomplished after the blank 60 is pulled down about the cap 56 such that there is a tight fit of cap 56 relative to the portions of blank 60 defining aperture 73.

Thus, as seen in FIGS. 6 and 7, the first, second, third and fourth portions of blank 60 form a harness received on cap 56 which has two legs each forming an extension on opposite sides of the harness. The adhesive secures the legs tightly against the opposed sides of the container and also secures the harness tightly against the cap so that upward movement of the cap 56 tears the material forming blank 60. As seen in FIGS. 6–7, a part of the cap 56 protrudes through the aperture 73 formed in blank 60, but any upward movement of the cap would tear the wrapping device so formed, since the cap has a bottom larger than the top and larger than the aperture 73. As seen in FIG. 8, the cap 56 has an area on the top thereof suitable for price-marking, in which the price would be clearly visible thereon.

Referring now to FIGS. 9–12, a blank 60' is shown which is similar to blank 60 shown in FIG. 5; however, the juxtaposition of various fold lines is different and the angular extent of the interior concave and convex edges forming the aperture is reversed. In addition, the outward configuration of the blank 60' is somewhat modified insofar as the diameter between the opposed outer edges of the central area is somewhat larger. For the sake of brevity, the parts shown in FIG. 9 have the same character numerals as those referring to the blank 60 of FIG. 5 with the addition of a "prime", the basic configuration, juxtaposition and dimentional relationships being the same for blank 60' as for blank 60 except for the specific differences described.

Figure 9:
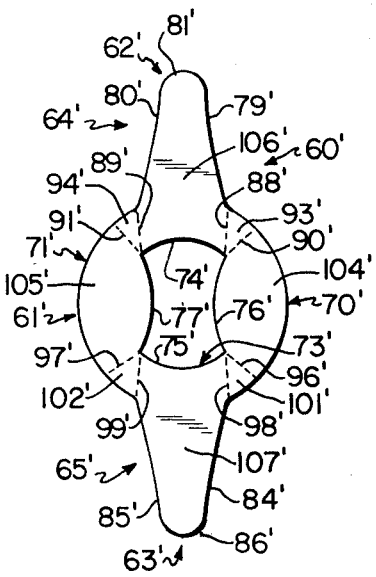
FIG. 9 is a top plan view of another modified blank forming a wrapping device in accordance with the present invention similar to that shown in FIG. 5; however, the perforated fold lines are somewhat modified.

Thus, as seen in FIG. 9, blank 60' has an aperture 73' formed therein wherein the opposed concave interior edges 74' and 75' have an angular extent in the arc of a circle of about 65–70 and wherein the opposed convex interior edges 76′ and 77′ have an angular extent in an arc of a circle of about 110–115.

The eight fold lines seen in FIG. 9, rather than converging into intersections adjacent the outer edges of the central area of the blank as in FIG. 5, diverge as they approach the exterior side edges and have their intersections adjacent the various edges defining aperture 73′.

Thus, fold lines 88′ and 90′ intersect adjacent the intersection of edges 74′ and 76′ and diverge therefrom into intersection with edge 70′ of central area 71′. Thus, a substantially triangular area 93′ is defined by fold lines 88′ and 90′ and a portion of outer edge 70′.

Similarly, fold lines 89′ and 91′ intersect adjacent the intersection of edges 74′ and 77′ and diverge therefrom into intersection with exterior outer edge 71′. A substantially triangular area 74′ is thereby defined by fold lines 89′ and 91′ and a part of edge 71′.

Similarly, fold lines 96′ and 98′ intersect adjacent the intersection of edges 75′ and 76′ and diverge therefrom into intersection with edge 70′, thereby defining a substantially triangular area 101′ therebetween.

Finally, the last two fold lines 97′ and 99′ intersect adjacent the intersection of edges 75′ and 77′ and diverge therefrom into intersection with a part of edge 71′, thereby defining a substantially triangular area 102′ therebetween.

Fold lines 98′ and 99′ are parallel, and fold lines 88′ and 89′ are parallel. Lines 88′ and 98′ are the same straight line, and lines 89′ and 99′ are in the same straight line.

Figure 10:
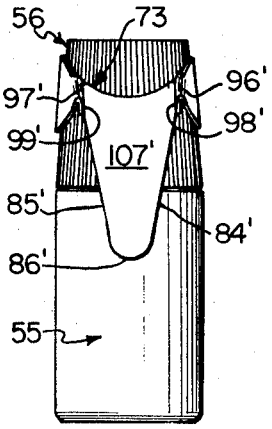
FIG. 10 is a front elevational view of the wrapping device shown in FIG. 9 which has been coupled to a capped container.
Figure 11:
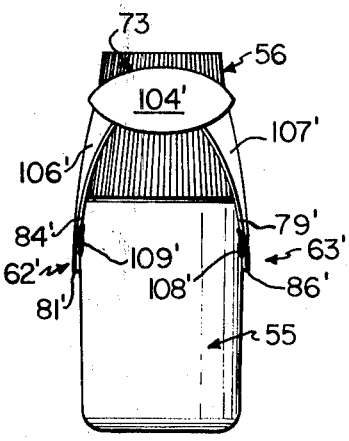
FIG. 11 is a right side elevational view of the wrapping device and capped container shown in FIG. 10.
Figure 12:
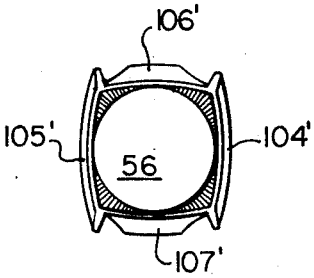
FIG. 12 is a top plan view of the wrapping device and capped container shown in FIG. 10.

Basically, the blank 60′ shown in FIG. 9 operates in the same fashion as blank 60 shown in FIG. 5, with cap 56 having a part protruding through aperture 73′ and the third and fourth portions 106′ and 107′ being adhered to the sides of container 55 as seen in FIGS. 10–11 by means of adhesive 108′ and 109′.

In order to obtain the configuration shown in these figures, portions 104′ and 105′ are folded along fold lines 90′, 91′, 96′ and 97′ so they are substantially parallel to the planes containins substantially triangular areas 93′, 94′, 101′ and 102′ and the third and fourth portions 106′ and 107′ are folded along fold lines 88′, 89′, 98′ and 99′, so that the planes containing the portions 106′ and 107′ are substantially perpendicular to the planes containing triangular areas 93′, 94′, 101′ and 102′. Then, the wrapping device so formed is slipped over cap 56 with the cap being received in aperture 73′ therein. Once the portions 106′ and 107′ are adhered to the opposed sides of the container 55 so that all four portions are secured tightly against the cap and portions 106′ and 107′ are secured tightly against opposed sides of the container, the wrapping device is in its fully operative position to detect upward movement of cap 56, such movement, of course, resulting in a tearing of the material forming the wrapping device. As indicated above, the tearing would most probably first result in the perforated fold lines formed in the blank.

Referring now to FIGS. 13–17, a blank 110 is illustrated which can be formed into a carton for containing a plurality of capped containers and in which the blank includes a plurality of wrapping panels which can be separated from the main carton and maintain an individual wrapping engagement with each of the plurality of capped containers.

Figure 13:
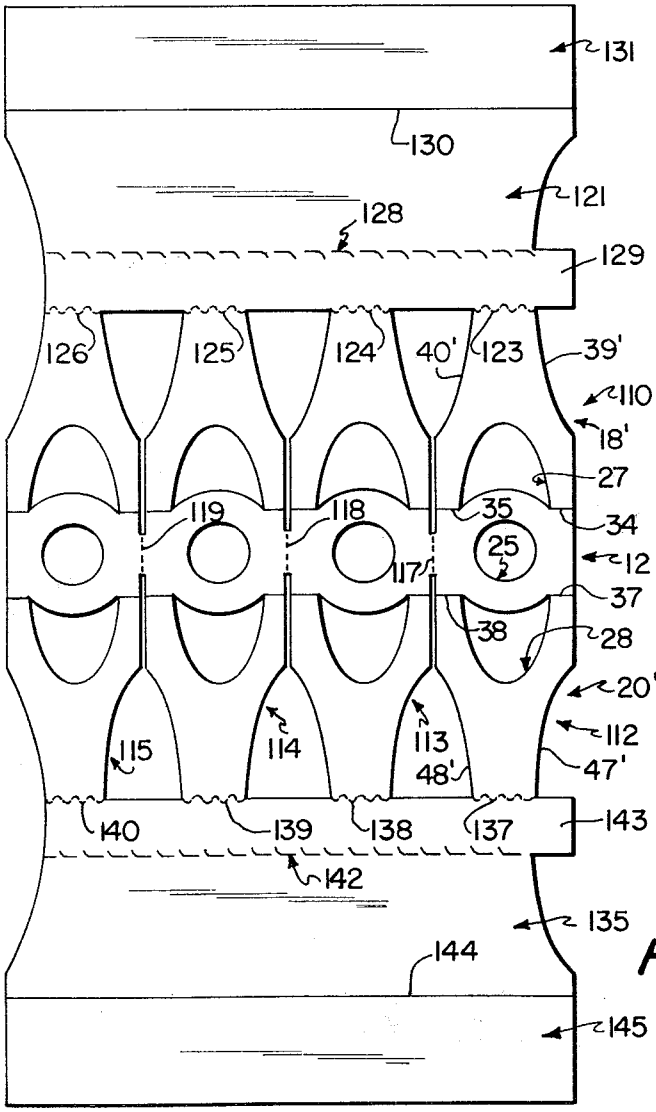
FIG. 13 is a top plan view of the outside surface of a blank having a plurality of the wrapping devices in accordance with the present invention formed therein.

As seen in FIG. 13, blank 110 is basically formed from a plurality of wrapping panels or devices similar to the wrapping device shown in FIG. 1, except that a plurality of the devices are coupled along perforated lines and there are additional panels coupled thereto. For the sake of brevity, those portions of the wrapping devices shown in FIG. 13, which are similar to those shown in FIG. 1 will be given the same character numerals, it being understood that these like parts have like dimensions, juxtapositions and configurations as the parts shown in FIG. 1 and described above. Where the parts are different, a precise explanation will be presented.

Thus, as seen in FIG. 13, a plurality of four wrapping devices 112, 113, 114 and 115 are shown, each of which, as set forth, for example, with regard to wrapping device 112, has a central area 12 and first and second intermediate areas 18′ and 20′. Each has two opposed apertures 27 and 28 and a central aperture 25. Similarly, each has four fold lines 34, 35, 37 and 38 as set forth above regarding blank 10 in FIG. 1. Each intermediate area 18′ and 20′ is somewhat modified and has shortened curvilinear edges 39′ and 40′ for area 18′ and 47′ and 48′ for area 20′. These edges are about one-half the length of the associated edges shown in FIG. 1.

Each of the wrapping devices is coupled to the next adjacent one along parallel perforated score lines, line 117 being between devices 112 and 113, line 118 being between devices 113 and 114 and line 119 being between devices 114 and 115. Although only four wrapping devices are shown, any desirable number can be utilized. As seen in FIG. 13, each of the perforated score lines extends along adjacent outer edges of the central area of each for only a short distance about equal to the diameter of each central aperture therein.

At the top of FIG. 13, a first side panel 121 is releasably coupled to each of the wrapping devices 112–115 at the end of the first intermediate area of each along perforated score lines 123, 124, 125 and 126, respectively. Spaced above the perforated score lines 123–126 is a straight perforated score line 128 extending completely across the first side panel 121 and substantially parallel to perforated score lines 123–126 and also substantially parallel to the fold lines in the central areas of each wrapping device 112–115. A tab 129 extends outwardly from the first side panel 121 between perforated score line 128 and perforated score line 123, which tab is grasped and pulled to ultimately sever the plurality of wrapping devices from the side panel 121. In other words, tab 129 and the material of the side panel 121 between perforated score lines 123–126 and perforated score line 128 form a zipper strip which is separable from the panel 121 and the wrapping devices.

Extending from the top of the first side panel 12 as seen in FIG. 13 along fold line 130 is a substantially rectangular first closure panel 131 which has a width seen in FIG. 13 substantially equal to the combined widths of the wrapping devices and a vertical length as seen in FIG. 13 substantially equal to the width of the bottom of the containers to be associated therewith.

As seen at the bottom of FIG. 13, a second side panel 135, which is the mirror image of the first side panel 121, is coupled along a plurality of perforated lines 137–140 to the bottom intermediate areas on wrapping devices 112–115. Similarly, a perforated score line 142 extends completely across the second side panel 135 and a tab 143 extends outwardly between perforated score lines 137 and 142 to define a tab for the zipper strip release thereby formed. A second closure panel 145, which is the mirror image of the first closure panel 131, is connected to the side panel 135 along fold line 144.

Figure 14:
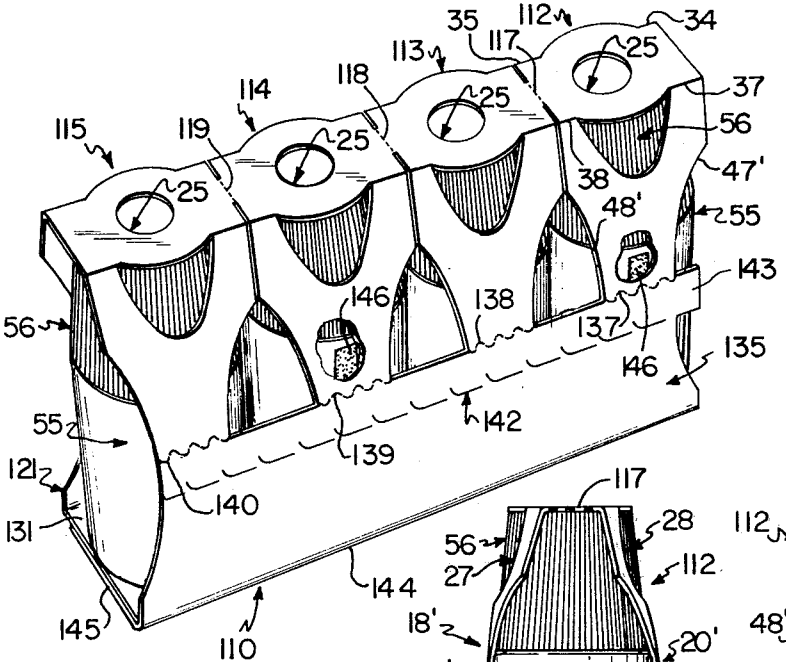
FIG. 14 is a right perspective view in elevation showing a plurality of capped containers secured in a carton formed from the blank shown in FIG. 13 with parts cutaway to show the strips of adhesive between the containers and the wrapping devices.

As seen in FIG. 14, a plurality of containers 55 having caps 56 thereon is conveniently enclosed by the carton formed from blank 110 shown in FIG. 13.

Specifically, all of the capped containers are placed in a line and the central areas of the wrapping devices 112–115 are placed on the top of the caps, the remaining portions of the wrapping devices and the two side panels and closure panels then being folded downwardly along the sides of each capped container about fold lines 34, 35, 37 and 38 in each of the wrapping devices. In addition, each of the closure panels 131 and 145 are folded along their associated fold lines 130 and 144 perpendicular to side panels 121 and 135 so that they overlap one another below the bottom of each of the containers 55. These closure panels are then adhered together by a suitable adhesive or other locking mechanism.

The dimensions of blank 110 are such that the capped containers shown in FIG. 14 are tightly received therein in a manner similar to the tight reception of the capped container shown and discussed above regarding FIG. 2.

Figure 15:
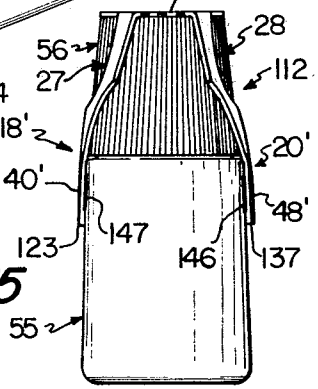
FIG. 15 is a side elevational view of a wrapping device and capped container secured thereto which has been removed from the carton shown in FIG. 14 by manipulation of two zipper strips.

However, in addition, as the wrapping devices are folded along fold lines 34, 35, 37 and 38, adhesive 146 and 147, as seen in FIGS. 14 and 15, is interposed between opposed sides of each container and the two intermediate areas for each above the associated perforated score lines 123–126 and 137–140. In other words, each container 55 is adhered to its associated wrapping device by means of adhesive interposed between each associated intermediate area on each wrapping device and the sides of the container. This is similar to the adhesive supplied with regard to the wrapping devices shown in FIGS. 6, 7, 10 and 11 above.

In such fashion, a carton for enclosing a plurality of capped containers is formed and this plurality of containers is shipped to a retail outlet. Once the carton is received at the outlet, the store clerk places a price-marking on each cap 56, advantageously through central aperture 25 in each of the wrapping devices.

After this is accomplished, the two zipper strips are pulled by grasping tabs 129 and 143 so as to sever each of the wrapping devices 112–115 from the associated side and closure panels 121, 131, 135 and 145. In addition, each of the wrapping devices associated with a capped container is severed from the adjacent ones by means of a tearing of the perforated score lines 117–119.

Figure 16:
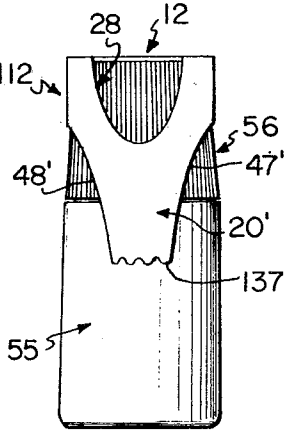
FIG. 16 is a front elevational view of the wrapping device and capped container shown in FIG. 15.
Figure 17:
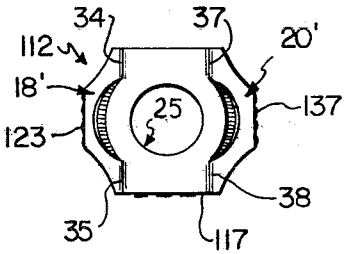
FIG. 17 is a top plan view of the wrapping device and capped container shown in FIG. 15.

This results in a plurality of individual wrapped containers as seen in FIGS. 15–17. Each wrapping device remains with its associated capped container because of the adhesive 146 and 147 previously interposed between the intermediate areas and the opposed sides of the container as seen in FIGS. 14 and 15. Thus, each capped container so delivered to a retail outlet has its own wrapping device securely connected thereto to provide an indication of possible tampering with the price-marked cap thereon. That is, any upward movement of the cap 56 shown in FIGS. 15–17, results in a tearing of the material forming the wrapping device 112 in a manner similar to that described above with regard to FIGS. 2–4 and FIGS. 5–12.

Figure 18:
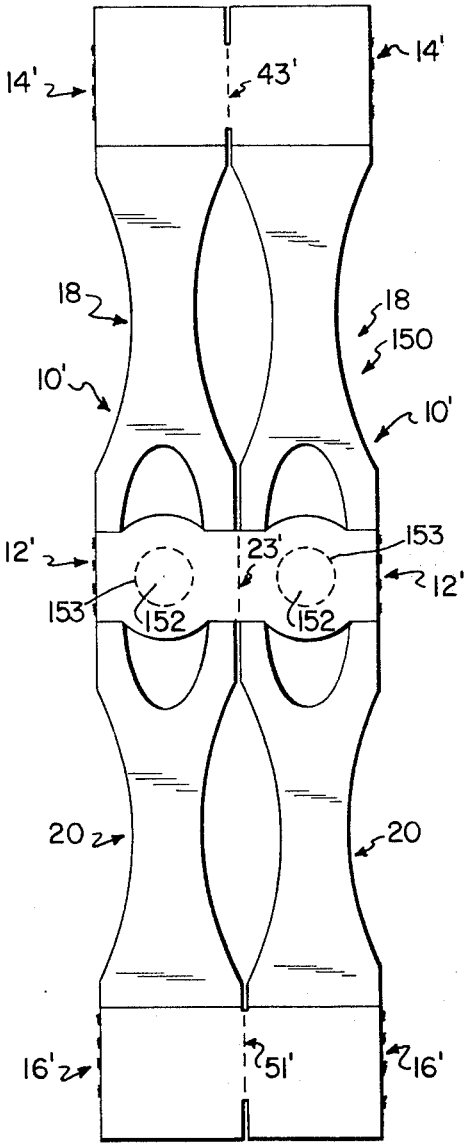
FIG. 18 is a top plan view of the outside surface of a blank formed from a plurality of blanks similar to that shown in FIG. 1 which are releasably coupled together by means of perforated score lines which are indicated in FIG. 18 by dashed lines, the two circular dashed lines indicating perforated areas and the interior straight lines indicating fold lines.

Referring now to FIG. 18, a blank 150 is shown which is basically formed by a plurality of blanks 10' similar to blank 10 shown in FIG. 1 coupled together along three adjacent perforated score lines. Since the two blanks 10' shown in FIG. 18 are essentially the same as blank 10 shown in FIG. 1, like character numerals have been used to indicate similar parts. The basic difference in blank 10 discussed above regarding FIG. 1 and each of the blanks 10' includes the three perforated score lines 23', 43' and 51' interconnecting adjacent central areas 12' and interconnecting the adjacent first and second end areas 14' and 16', respectively. In addition, each blank 10' has a circular separable area 152 filling the central aperture 25 as shown in blank 10 in FIG. 1, each of the circular separable areas 152 being releasably connected to the central area of each blank by means of circular frangible perforated or nicked score line 153 which defines the circular separable area.

In all other respects, blanks 10' and 10 are the same. Although only two blanks 10' are shown in FIG. 18, the overall blank 150 can comprise as many individual blanks 10' as desired.

These blanks 10' formed from blank 150 can be folded into wrapping devices and secured to a plurality of capped containers in a manner similar to that described above regarding blank 10 in FIGS. 1–4. Then, each of the individually wrapped capped containers is separated by tearing of the perforated score lines 23', 43' and 51' between adjacent wrapping devices 10'.

At this time, a plurality of these wrapped containers are aligned adjacent each other and a spot of adhesive 156 is placed in each separable area 152. Then, an elongated coupling member 157, which can be in the form of a rectangular piece of paperboard or cardboard, is placed into contact with each spot of adhesive 156 as shown in FIG. 20. Thus, the plurality of wrapped containers are conveniently assembled together. These coupled wrapped capped containers are then shipped to the retail outlet, where the store clerk easily individually separates each wrapped container by an upward pulling of the elongated member 157 as shown in FIG. 21. Since the separable area 152 is adhered via adhesive 156 to the elongated member 157 and is merely coupled to the individual wrapping device by means of the frangible perforated score line 153, such a pulling severs the separable area 152 from the wrapping device, as shown in FIG. 21. Thus, each wrapped device is thereby separated from the rest and the store clerk can then place the price-marking for the capped container in the area now exposed by separation of the separable area 152.

Alternatively, each of the separated, individually wrapped containers can be taped together or enclosed together in a film thereby coupling them together. In this case, the separable areas 152 need not be used and can be eliminated from the blanks 10'.

In addition, a carton for enclosing a plurality of the capped containers can be formed by using the blank 150, in a manner similar to that described regarding blank 10, with the individual blanks 10' therein remaining coupled together along their adjacent perforated fold lines. In this case the separable areas 152 need not be used and can be eliminated from the blanks 10'.

The various strips and spots of adhesive described above for adhering the wrapping devices to the capped containers, for adhering the carton parts together, and for adhering the elongated strip to the separable areas can be applied just prior to the adhering step. Alternately, the adhesive can be preapplied to the blanks and can be reactivated at the time of packaging.

While advantageous embodiments have been chosen to illustrate the present invention, it will be understood by those skilled in the art that various changes and modifications can be made therein without departing from the scope of the invention as defined in the appended claims.

What is claimed is:

1. A device for detecting tampering with a cap on a container, the combination comprising:

a harness received on the cap;

two legs, each forming an extension on opposite sides of said harness;

said harness and legs being formed of tearable material; and means for securing said legs tightly against opposed sides of the container and for securing said harness tightly against the cap so that upward movement of the cap tears said device, said harness having means defining at least one aperture therein permitting protrusion of a part of the cap through said harness, said means including a central area on said harness having a pair of opposed side edges, at least a portion of said one aperture therein, and a first pair of fold lines, one of said fold lines extending from said one aperture to the other of said central area side edges.

2. A device according to claim 1, wherein said harness has means defining two opposed apertures therein both permitting protrusion of a part of the cap through said harness.

3. A device according to claim 2, and further including means, in said harness, for defining a central aperture therein between said two opposed apertures, the cap being visible through said central aperture.

4. A device according to claim 2, wherein said harness includes two pairs of fold lines, the fold lines in the first pair extending from one of said apertures respectively to opposed edges of said harness and the fold lines in the second pair extending from the other of said apertures respectively to opposed edges of said harness.

5. A device according to claim 1, wherein said means for securing comprises overlapping bottom portions extending from each of said legs and means for attaching together said bottom portions.

6. A device according to claim 5, wherein said means for attaching comprises adhesive.

7. A device according to claim 5, wherein said bottom portions overlap in the area of the container's bottom.

8. A device according to claim 2, wherein each of said apertures has a shape formed by the intersection of a parabola and an arc of a circle.

9. A device according to claim 1, wherein said aperture has four interior edges, two of these edges being opposed and concave and the other two edges being opposed and convex.

10. A device according to claim 1, wherein said harness has four fold line means for dividing said harness into four portions.

11. A device according to claim 10, wherein each of said four fold line means comprises two intersecting fold lines.

12. A device according to claim 11, wherein each of said two intersecting fold lines and a portion of the edge of said aperture define a substantially triangular area therebetween.

13. A device according to claim 11, wherein each of said two intersecting fold lines and a portion of the outer edge of said harness define a substantially triangular area therebetween.

14. A carton for a plurality of capped containers comprising:

a plurality of wrapping devices coupled along perforated lines therebetween;

each of said wrapping devices comprising a harness received on the container's cap, and two legs, each forming an extension on opposite sides of said harness, said harness having means defining at least one aperture therein permitting protrusion of a part of the cap through said harness; said means including a central area on said harness having a pair of opposed side edges, at least a portion of said one aperture therein, and a first pair of fold lines, one of said fold lines extending from said one aperture to one of said central area side edges and the other of said fold lines extending from said one aperture to the other of said central area side edges.

15. A carton according to claim 14, wherein said means for securing includes means for interconnecting said first and second side panels below the containers.

16. A carton according to claim 15, wherein said means for interconnecting comprises a first bottom closure panel hingedly coupled and perpendicular to said first side panel along a fold line, and a second bottom closure panel hingedly coupled and perpendicular to said second side panel along a fold line.

17. A carton according to claim 16, wherein said bottom closure panels overlap, and said means for interconnecting includes adhesive interposed between said overlapping bottom closure panels.

18. A carton according to claim 14, wherein said means for securing further includes adhesive interposed between each of the containers and the two legs associated therewith.

19. An assembly for enclosing a plurality of capped containers comprising:

a plurality of wrapping devices, each associated with one capped container and each comprising a harness received on the associated container's cap, two legs, each forming an extension on opposite sides of said harness, said harness having means defining at least one aperture therein permitting protrusion of a part of the associated cap through said harness, said means including a central area on said harness having a pair of opposed side edges, at least a portion of said one aperture therein, and a first pair of fold lines, one of said fold lines extending from said one aperture to one of said central area side edges and the other of said fold lines extending from said one aperture to the other of said central area side edges, and means for securing said legs tightly against opposed sides of the associated container and for securing said harness tightly against the associated cap, said harness having a separable area therein and frangible means for coupling said separable area to said harness;

an elongated member extending along each of said plurality of wrapping devices, and adhesive means, interposed between said elongated member and said separable areas, for connecting said plurality of wrapping devices to said elongated member.

20. An assembly according to claim 19, wherein each of said separable areas is circular.

21. A unitary blank adapted to be wrapped about a capped container comprising:

a central area having opposed side edges;

a first end area having an edge;

a first intermediate area having opposed side edges interconnecting said central area side edges and said first end area edge;

a second end area having an edge;

a second intermediate area having opposed side edges interconnecting said central area side edges and said second end area edge;

said central area having at least a portion of a first aperture therein and a first pair of fold lines, one of said fold lines extending from said first aperture to one of said central area side edges and the other of said fold lines extending from said first aperture to the other of said central area side edges.

22. A unitary blank according to claim 21, and further including at least a portion of a second aperture located in said central area, and a second pair of fold lines, one of said second pair of fold lines extending from said second aperture to one of said central area side edges and the other of said second pair of fold lines extending from said second aperture to the other of said central area side edges.

23. A unitary blank according to claim 22, wherein said apertures each have a shape formed by the intersection of a parabola with an arc of a circle.

24. A unitary blank according to claim 23, wherein each of said fold lines extends from the intersection of the parabola and the arc of a circle forming said apertures to said central area side edges.

25. A unitary blank according to claim 22, and further including a central aperture in said central area between said first and second apertures.

26. A unitary blank according to claim 25, wherein said central aperture is circular.

27. A unitary blank according to claim 21, wherein said central area side edges are straight and parallel.

28. A unitary blank according to claim 21, wherein said side edges of said first and second intermediate areas are concave.

29. A unitary blank according to claim 21, wherein said edges of said first and second end areas are each comprised of two straight side portions and a straight end portion, each of said end areas having a fold line therein between the two straight side portions.

30. A unitary blank according to claim 21, and further including a second pair of fold lines, one extending from said first aperture to one of said central area side edges and the other extending from said first aperture to the other of said central area side edges.

31. A unitary blank according to claim 30, and further including a third pair of fold lines, one extending from said first aperture to one of said central area side edges and the other extending from said first aperture to the other of said central area side edges.

32. A unitary blank according to claim 31, and further including a fourth pair of fold lines, one extending from said first aperture to one of said central area side edges and the other extending from said first aperture to the other of said central area side edges.

33. A unitary blank according to claim 21, wherein said aperture has a shape formed by the intersection of four interior side edges, two of these being opposed and concave and the other two being opposed and convex.

34. A unitary blank according to claim 33, wherein said concave edges extend across the longitudinal axis of said blank between said end areas, and said convex edges extend across the transverse axis of said blank between said central area side edges.

35. A unitary blank according to claim 32, wherein said fold lines in said first pair and said second pair are arranged so that said fold lines in each of these pairs extending to said one side edge of said central area intersect and so that said fold lines in each of these pairs extending to said other side edge of said central area intersect.

36. A unitary blank according to claim 35, wherein said fold lines in said third pair and said fourth pair are arranged so that said fold lines in each of these pairs extending to said one side edge of said central area intersect and so that said fold lines in each of these pairs extending to said other edge of said central area intersect.

37. A unitary blank according to claim 36, wherein said intersections of said fold lines are adjacent said central area side edges.

38. A unitary blank according to claim 36, wherein said intersections of said fold lines are adjacent said first aperture.

39. A unitary blank adapted to be wrapped about a plurality of capped containers comprising:

at least two wrapping panels coupled along a perforated fold line, each wrapping panel comprising a central area having opposed side edges, a first end area having an edge, a first intermediate area having opposed side edges interconnecting said central area side edges and said first end area edge, a second end area having an edge, a second intermediate area having opposed side edges interconnecting said central area side edges and said second end area edge, said central area having two apertures therein and two pairs of fold lines, the first pair extending from one of said apertures to the opposed side edges of said central area and the other pair extending from the other of said apertures to the opposed side edges of said central area, a first closure panel including a bottom portion hingedly coupled along a fold line to a side portion, said side portion coupled to said wrapping panels first end areas along perforated lines and having a perforated line extending across thereof, and a second closure panel including a bottom portion hingedly coupled along a fold line to a side portion, said side portion coupled to said wrapping panels second end areas along perforated lines and having a perforated line extending across thereof.

40. A unitary blank adapted to be wrapped about a plurality of capped containers comprising:

at least two adjacent wrapping panels, each wrapping panel comprising a central area having opposed side edges, a first end area having an edge and a transverse fold line, a first intermediate area having opposed side edges interconnecting said central area side edges and said first end area edge, a second end area having an edge and a transverse fold line, a second intermediate area having opposed side edges interconnecting said central area side edges and said second end area edge, said central area having two apertures therein and two pairs of fold lines, the first pair extending from one of said apertures to the opposed side edges of said central area and the other pair extending from the other of said apertures to the opposed side edges of said central area, each wrapping panel being coupled to the next adjacent wrapping panel by means of three perforated lines, the first extending between adjacent side edges of the central areas, the second extending between adjacent portions of the edges of the first end areas, and the third extending between adjacent portions of the edges of the second end areas.

41. A unitary blank according to claim 40, wherein each of said central areas includes a perforated line enclosing a separable area.

42. A device according to claim 2, and further including at least a portion of a second aperture located in said central area, and a second pair of fold lines, one of said second pair of fold lines extending from said second aperture to one of said central area side edges and the other of said second pair of fold lines extending from said second aperture to the other of said central area side edges.

* * * * *